US005256165A

United States Patent [19]

Herbstman et al.

[11] Patent Number: 5,256,165

[45] Date of Patent: Oct. 26, 1993

[54] GASOLINE DETERGENT ADDITIVE MIXTURE OF MONO-AND BIS-SUCCINIMIDES AND HEAVY OIL

[75] Inventors: Sheldon Herbstman, New City; Benjamin J. Kaufman, Hopewell Junction; William H. Bitting, Chester; Peter J. Choate, Fishkill, all of N.Y.

[73] Assignee: Texaco Inc, White Plains, N.Y.

[21] Appl. No.: 817,219

[22] Filed: Jan. 6, 1992

[51] Int. Cl.[5] ..... C10L 1/22

[52] U.S. Cl. ..... 44/347; 252/51.5 A

[58] Field of Search ..... 44/347; 252/51.5 A

[56] References Cited

U.S. PATENT DOCUMENTS

| | | | |
|---|---|---|---|
| 3,004,987 | 10/1961 | Paris et al. | 44/347 |
| 3,307,928 | 3/1967 | Chaikivsky et al. | 44/347 |
| 4,039,300 | 8/1977 | Chloupek et al. | 44/347 |
| 4,240,803 | 12/1980 | Andress, Jr. | 44/347 |
| 4,460,381 | 7/1984 | Karol et al. | 44/347 |
| 5,030,249 | 7/1991 | Herbstman et al. | 44/347 |
| 5,039,307 | 8/1991 | Herbstman et al. | 44/347 |
| 5,114,435 | 5/1992 | Abramo et al. | 44/348 |

FOREIGN PATENT DOCUMENTS

| | | | |
|---|---|---|---|
| 0376578A1 | 7/1990 | European Pat. Off. . | |
| 1486144 | 9/1977 | United Kingdom | 44/347 |

*Primary Examiner*—Jacqueline Howard

*Attorney, Agent, or Firm*—James J. O'Loughlin; Christopher Nicastri

[57] ABSTRACT

A multi-functional motor fuel additive comprising (a) a mono-polyalkenylsuccinimide, (b) a bis-polyalkenylsuccinimide and (c) a heavy oil is provided. A motor fuel composition comprising a major portion of a base fuel and a minor portion, sufficient to provide port fuel injector and intake valve detergency, of the multi-functional motor fuel additive of the present invention and a concentrate of the multi-functional motor fuel additive of the present invention are also provided.

24 Claims, No Drawings

GASOLINE DETERGENT ADDITIVE MIXTURE OF MONO-AND BIS-SUCCINIMIDES AND HEAVY OIL

BACKGROUND OF THE INVENTION

1. Field of the Invention

This invention is related to a multi-functional motor fuel additive composition which is active in preventing deposits from forming in port fuel injectors and on intake valves. More particularly, this invention relates to:

I) a multi-functional motor fuel additive composition comprising (a) a mono-polyalkenylsuccinimide, (b) a bis-polyalkenylsuccinimide and (c) a heavy oil;

II) a motor fuel composition comprising a major portion of a base fuel and a minor portion of the multi-functional motor fuel additive of the present invention; and III) a concentrate of the multi-functional motor fuel additive of the present invention.

2. Description of Related Information

Combustion of a hydrocarbon motor fuel in an internal combustion engine generally results in the formation and accumulation of deposits on various parts of the combustion chamber as well as in the fuel intake and on the exhaust systems of the engine.

The accumulation of deposits in the port fuel injectors of the engine, in particular, tend to cause misfueling, which promotes incomplete fuel combustion and leads to rough engine idling and engine stalling. Excessive hydrocarbon and carbon monoxide exhaust emissions are also produced under these conditions. It would therefore be desirable from the standpoint of engine operability and overall air quality to provide a motor fuel composition which minimizes or overcomes the above described problems.

Another problem common to internal combustion engines is the formation of intake valve deposits. Intake valve deposits interfere with valve closing and eventually result in poor fuel economy. Such deposits interfere with valve motion and valve sealing, cause valve sticking, and, in addition, reduce volumetric efficiency of the engine and limit maximum power. Valve deposits are usually a result of thermally and oxidatively unstable fuel or lubricating oil oxidation products. Hard carbonaceous deposits collect in the tubes and runners that conduct the exhaust gas recirculation (EGR) gases. These deposits are believed to be formed from exhaust particles which are subjected to rapid cooling while mixing with the air-fuel mixture. Reduced EGR flow can result in engine knock and $NO_x$ emission increases. It would therefore be desirable to provide a motor fuel composition which minimizes or overcomes the formation of intake valve deposits and subsequent valve sticking problems.

Thus, today's gasoline technology requires additives which are multi-functional. This presents an additional problem. Multi-functional additives are difficult to develop, because improved activity in one area of gasoline engine deposit control can result in reduced deposit control in another area. An example of this problem occurs with the aforementioned port fuel injectors and intake valves. An additive which improves port fuel injector detergency usually results in an increase in intake valve deposits: an undesirable result. It would therefore be desirable to provide a motor fuel composition containing a multi-functional additive which minimizes or overcomes this problem by controlling the formation of deposits in port fuel injectors, without aggravating the intake valve deposit problem.

Therefore, it is an object of the present invention to provide both a multi-functional additive composition and a motor fuel composition which significantly reduce the tendency of port fuel injectors to become plugged with deposits. It is another object of the present invention that the multi-functional additive composition and the motor fuel composition not only reduce port fuel injector deposits, but also do not aggravate the tendency of intake valves to form deposits. Yet another object of the present invention is to provide a concentrate composition comprising the above described multi-functional motor fuel additive for use in a motor fuel composition.

It is a feature of this invention that port fuel injectors in engines which are operated on the motor fuel composition of the present invention develop a significantly smaller amount of deposits than port fuel injectors in engines which are operated on motor fuels which do not contain the multi-functional additive composition of the present invention. It is another feature of this invention that the decrease in port fuel injector plugging is obtained without a concomitant increase in the formation of intake valve deposits.

Motor fuel compositions of the instant invention are advantageous in that they significantly reduce the accumulation of deposits in port fuel injectors, with a concomitant reduction of harmful emissions and increase in engine operability. Simultaneously, intake valve deposit formation is reduced, with a concomitant reduction in valve sticking and increase in valve life, cold starting ability and overall engine operability.

SUMMARY OF THE INVENTION

The present invention provides a motor fuel additive composition comprising:

a first component comprising:

between about 65 wt. % and about 95 wt. %, based upon the total weight of the first component, of a bis-succinimide of general formula:

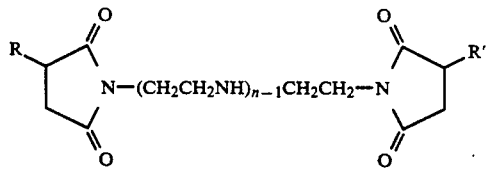

and between about 35 wt. % and about 5 wt. %, based upon the total weight of the first component, of a mono-succinimide of general formula:

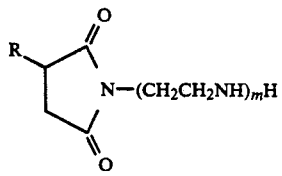

where R and R' are polyalkenyl radicals with average molecular weights of about 300 to about 4000 and n and m are integers between about 1 and about 6; and a second component comprising a heavy oil;

wherein the motor fuel additive composition comprises between about 25 wt. % and about 55 wt. % of the first component and between about 75 wt. % and about 45 wt. % of the second component, based upon the total weight of the motor fuel additive composition.

The present invention also provides a motor fuel composition comprising a major portion of a hydrocarbon fuel boiling in the gasoline range between 90° F. and about 450° F. and a minor portion of the additive composition described above where the motor fuel additive is present in an amount sufficient to reduce the formation of deposits in port fuel injectors and on intake valves.

A concentrate of the additive composition of the present invention is also contemplated.

DETAILED DESCRIPTION OF THE INVENTION

Applicants have discovered a motor fuel additive composition which unexpectedly reduces port fuel injector plugging and intake valve deposit formation. The motor fuel additive composition of the present invention comprises:

a first component comprising:

between about 65 wt. % and about 95 wt. %, based upon the total weight of the first component, of a bis-succinimide of general formula:

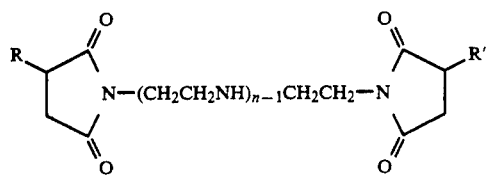

and between about 35 wt. % and about 5 wt. %, based upon the total weight of the first component, of a mono-succinimide of general formula:

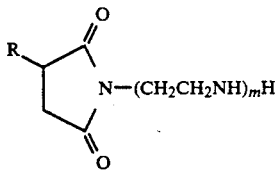

where R and R' are the same or different polyalkenyl radicals with average molecular weights of about 300 to about 4000 and n and m are integers between about 1 and about 6; and a second component comprising a heavy oil;

wherein the motor fuel additive composition comprises between about 25 wt. % and about 55 wt. % of the first component and between about 75 wt. % and about 45 wt. % of the second component, based upon the total weight of the motor fuel additive composition.

In a preferred embodiment, the first component preferably comprises between about 75 wt. % and about 85 wt. % of the bis-succinimide and between about 25 wt. % and about 15 wt. % of the mono-succinimide, based upon the total weight of the first component. In a more preferred embodiment, the first component comprises between about 80 wt. % and about 85 wt. % of the bis-succinimide and between about 20 wt. % and about 15 wt. % of the mono-succinimide, based upon the total weight of the first component.

In a preferred embodiment, the motor fuel additive composition of the present invention comprises between about 25 wt. % and about 45 wt. % of the first component and between about 75 wt. % and about 55 wt. % of the second component, based upon the total weight of the motor fuel additive composition. In a more preferred embodiment, the motor fuel additive composition of the present invention comprises between about 30 wt. % and about 40 wt. % of the first component and between about 70 wt. % and about 60 wt. % of the second component, based upon the total weight of the motor fuel additive composition.

The succinimides useful in the practice of the present invention can be produced by reacting a polyalkenyl succinic acid anhydride of general formula:

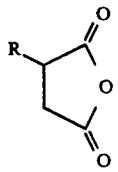

where R is a polyalkenyl radical with an average molecular weight of about 300 to about 4000, with a polyethylenepolyamine: $NH_2(CH_2CH_2NH)_nH$, where n is an integer between 1 and 6.

The Polyalkenyl Succinic Acid Anhydride

The polyalkenyl succinic acid anhydrides useful in the practice of the present invention comprise succinic acid anhydride substituted with a polyalkenyl radical, R. The polyalkenyl radical, R, preferably has a molecular weight of about 1000 to about 2500, and, more preferably, a molecular weight of about 1200 to about 1500. Typical olefins which can be polymerized to produce the alkenyl radical include ethylene, propylene, butylene, amylene, etc.

In a preferred embodiment, R is a polyisobutenyl radical, and the polyalkenyl succinic acid anhydride is polyisobutenyl succinic acid anhydride (PIBSA). PIBSA is most preferably formed by reacting maleic anhydride and a polybutene such as a polyisobutene commercially available from Amoco Chemical Company under the INDOPOL® series trade name, the most preferred polybutene reactant being commercially available as INDOPOL® H-300 (avg. m.w. ≈1290). Methods of formulating the above described polyisobutenyl succinic acid anhydride reactant are disclosed by, inter alia, U.S. Pat. Nos. 4,496,746 (Powell), 4,431,825 (Powell), 4,414,397 (Powell), and 4,325,876 (Chafetz), all incorporated herein by reference.

The Polyethylenepolyamine

The polyethylenepolyamines useful in the practice of the present invention are represented by the general formula $NH_2(CH_2CH_2NH)_nH$, where n is preferably an integer between about 2 and about 4, and most preferably n is 3. The following are typical polyethylenepolyamines which, when reacted with a polyalkenyl succinic acid anhydride, provide the additives described by the above formulas: ethylene diamine; diethylene triamine (DETA); triethylene tetramine (TETA); tetraethylenepentamine (TEPA); pentaethylenehexamine (PEHA); and hexaethyleneheptamine (HEHA). These polyethylenepolyamines are commercially available from the Texaco Chemical Company.

As described above, the detergent additives of the present invention can be prepared by reacting a polyalkenyl succinic acid anhydride, e.g., PIBSA, with a polyethylenepolyamine. This reaction can be carried out under a nitrogen atmosphere, at a temperature ranging from about 50° F. to about 450° F. Overhead byproducts are removed at reduced pressure, and the succinimide product is collected.

The polyalkenyl succinimides of the present invention can be produced as illustrated by the following example.

EXAMPLE 1

1389 g (1 mole) of polyisobutenyl succinic acid anhydride (PIBSA) (avg. mol. wt. 1389) is mixed with stirring in a reaction vessel with 189 g (1 mole) of tetraethylenepentamine (TEPA) under a nitrogen atmosphere at 100° F. The temperature is raised to 350° F. and stirring is continued for 2 hours. Pressure in the vessel is then reduced for a period of one hour to remove water produced by the reaction. 1560 g (1 mole) of the mono-succinimide is collected.

It will be understood by those skilled in the art that the bis-succinimide can be produced under the same reaction conditions as in Example 1, with the exception that the PIBSA reactant will be present in excess, i.e., in a ratio of at least 2:1 (preferably greater) as compared to the polyethylenepolyamine.

The heavy oil component of the motor fuel additive of the present invention is an unrefined or a refined heavy oil. Unrefined oils are those obtained directly from a natural or synthetic source without further purification treatment. Refined oils are similar to unrefined oils except they have been further treated in one or more purification steps to improve one or more properties. Many such purification techniques (e.g., solvent extraction, secondary distillation, acid or base extraction, filtration, percolation) are well known to those skilled in the art. A particularly preferred class of heavy oils for use are known to those skilled in the art as paraffinic Solvent Neutral Oils (SNO). A preferred paraffinic solvent neutral oil for use as the heavy oil component of the motor fuel additive of the present invention is SNO-600, which has a viscosity of 20-60, say 25 centistokes (cst) at 40° C.

The present invention also provides a motor fuel composition which comprises a major portion of a hydrocarbon fuel boiling in the gasoline range between 90° F. and about 450° F., and a minor portion of the additive combination described above sufficient to reduce the formation of deposits on port fuel injectors and intake valves.

Preferred base motor fuel compositions are those intended for use in spark ignition internal combustion engines. Such motor fuel compositions, generally referred to as gasoline base stocks, preferably comprise a mixture of hydrocarbons boiling in the gasoline boiling range, preferably from about 90° F. to about 450° F. This base fuel may consist of straight chain or branched chain paraffins, cycloparaffins, olefins, aromatic hydrocarbons, or mixtures thereof. The base fuel can be derived from, among others, straight run naphtha, polymer gasoline, natural gasoline, or from catalytically cracked or thermally cracked hydrocarbons and catalytically reformed stock. The composition and octane level of the base fuel are not critical and any conventional motor fuel base can be employed in the practice of this invention. In addition, the motor fuel composition may contain any of the additives generally employed in gasoline. Thus, the fuel composition can contain anti-knock compounds such as tetraethyl lead compounds, anti-icing additives, and the like.

In a broad embodiment of the fuel composition of the present invention, the concentration of the additive composition is about 90 to about 360 PTB (pounds per thousand barrels of gasoline base stock). In a preferred embodiment, the concentration of the additive composition is about 135 to about 270 PTB. In a more preferred embodiment, the concentration of the additive composition is about 150 to about 200 PTB.

For example, a preferred motor fuel composition according to the present invention comprises a gasoline base stock, 10 PTB mono-succinimide, 50 PTB bis-succinimide, and 115 PTB heavy oil.

The additive composition of the present invention is effective in very small concentrations and, therefore, for consumer end use it is desirable to package it in dilute form. Thus, a concentrate of the additive composition of the present invention can be provided comprising a diluent e.g., xylene and about 1 to about 50 wt. % of the additive.

The advantages of the present invention are illustrated by the following examples. These examples are not intended to limit the scope of the present invention in any manner. Those skilled in the art will understand that the additive of the present invention may be formulated in other proportions.

In the following examples, the bis-succinimide employed, represented by the formula:

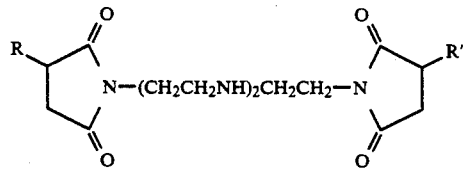

is the product of PIBSA and triethylene tetramine, and the mono-succinimide employed, represented by the formula:

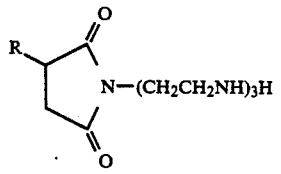

is also the product of PIBSA and triethylene tetramine.

EXAMPLES A-C

Port Fuel Injector Keep Clean Evaluation

The motor fuel composition of the instant invention is advantageous in that it reduces port fuel injector plugging in engines. The advantage of the instant invention in controlling port fuel injector plugging has been shown by a comparison of the performance of the following fuel compositions:

TABLE 1

| Component | Example A[1] | Example B (PTB) | Example C (PTB) |
|---|---|---|---|
| bis-succinimide | — | 75 | 50 |
| mono-succinimide | — | — | 10 |
| heavy oil (SNO-600) | — | 100 | 115 |
| corrosion inhibitor[2] | — | 1 | 1 |

[1]The base fuel for each of the tested fuels, Examples A–C was Conoco Rex ® an unleaded, non-additized, and non-oxygenated gasoline motor fuel.
[2]DCI-6A, a corrosion inhibitor available from DuPont.

Example A was an unadditized fuel. Example B contained a detergent additive, but lacked the mono-succinimide component of the motor fuel additive composition of the present invention. Example C was a motor fuel composition according to the present invention.

Examples A–C were subjected to the Port Fuel Injector Keep Clean Test. Example C's performance as compared to Examples A and B (as detailed below) validates the performance of an additive composition of the present invention as a superior port fuel injector "keep clean" detergent.

Port Fuel Injector Keep Clean Test

The keep clean test procedure was performed using three engines equipped with new fuel injectors. At the beginning of the test, the flow capacities of all of the injectors were measured. Each engine was operated on its respective test fuel for the prescribed test cycle (see below) and the fuel injectors were flow-tested every 500 miles to determine their flow capacities. A flow loss (plugging) of more that 10% is considered the failing criterion.

Test Program

The test vehicle and engine used was a Chrysler 2.2 L turbocharged engine. The engine was tuned to the manufacturer's specifications.

Test Cycle

The operating cycle consisted of 15 minutes of operation at 55 mph (road load) followed by 45 minutes hot soak with the engine shut off. No special actions were taken during the hot soak (i.e., no additional insulating of the engine).

Injector Flow-Rate Measurement

The laboratory flow apparatus controlled fuel pressure at about the same level as the fuel rail pressure of the vehicle engine during operation. A light hydrocarbon was used for flow-rate tests. The injector was flowed statically (wide-open) for ten seconds and the flow rate was measured. Decrease in flow rate is reported below as "% plugging".

The results of the Port Fuel Injector Keep Clean Test are summarized in the following table:

TABLE 2

| Mileage | Example A[1] (% Plugged) | Example B[2] (% Plugged) | Example C[3] (% Plugged) |
|---|---|---|---|
| 500 | 0.4 | 0.7 | −0.3 |
| 1000 | N/A | −0.4 | −0.1 |
| 1500 | 3.2 | 0.9 | 0.0 |
| 2000 | 5.5 | 0.9 | 0.2 |
| 2500 | 5.8 | 0.8 | |
| 3000 | 9.0 | 0.7 | |
| 3500 | 10.5 | 0.8 | |
| 4000 | | 1.3 | |
| 4500 | | 1.5 | |

TABLE 2-continued

| Mileage | Example A[1] (% Plugged) | Example B[2] (% Plugged) | Example C[3] (% Plugged) |
|---|---|---|---|
| 4900 | | | |

[1]Test terminated at 3500 miles due to injectors reaching 10% plugged value.
[2]Test terminated at 4900 miles due to test vehicle developing leak in coolant system.
[3]Test terminated at 2000 miles due to test vehicle of Example B developing leak in coolant system.

These results demonstrate the efficacy of the motor fuel composition of the present invention in reducing port fuel injector plugging over both an unadditized base fuel and a fuel which contains a detergent. At 2000 miles the engine burning base fuel was 5.5% plugged, and the engine burning the fuel additized with only the bis-succinimide detergent was 0.9% plugged. On the other hand, the engine which burned the fuel composition of the present invention was only 0.2% plugged. These results evidence the significant port fuel injector detergent activity of the motor fuel composition of the present invention.

EXAMPLES D AND E

Intake Valve Clean Keep Clean Test

The motor fuel composition of the present invention is also advantageous in that it reduces intake valve deposit formation. The advantage of the instant invention in controlling intake valve deposit formation has been shown by the comparison of the performance of a motor fuel composition of the present invention and a motor fuel with an insufficient amount of the heavy oil component of the additive of the present invention. The following fuel compositions were subjected to Honda Generator-IVD "Keep Clean" testing:

TABLE 3

| Example D | Example E |
|---|---|
| base fuel | base fuel |
| 50 PTB bis-succinimide | 50 PTB bis-succinimide |
| 20 PTB mono-succinimide | 20 PTB mono-succinimide |
| 21 PTB SNO-600 | 105 PTB SNO-600 |

The Honda Generator Test employed a Honda ES6500 generator with the following specifications:

TABLE 4

| Honda ES6500 Generator | |
|---|---|
| Type: | 4-stroke, overhead cam, 2-cylinder |
| Cooling system: | Liquid-cooled |
| Displacement: | 369 cubic cm. (21.9 cu. in) |
| Bore × stroke: | 56 × 68 mm (2.3 × 2.7 in) |
| Maximum Horsepower: | 12.2 HP/3600 rpm |
| Maximum Torque: | 240 kg-cm (17.3 ft-lb)/3000 rpm |

Each generator was equipped with an auto-throttle controller to maintain the rated speed when load was applied. Load was applied to each generator by plugging in a water heater. Various loads were simulated by changing the size of the water heaters connected to the generator.

The procedure for the Honda Generator Test can be described as follows. The test was started with a new or clean engine (clean valve, manifold, cylinder head, combustion chamber) and a new charge of lubricant. The generator was operated for 80 hours on the fuel to be tested following the test cycle of 2 hours at 1500 Watt load and 2 hours at 2500 Watt load, both at 3600 r.p.m. The engine was thereafter disassembled and the cylinder head stored, with valve spring and seal removed, in a freezer overnight at 0° F.

IV Stickiness Test

A trained rater quantified the effort to push open the intake valves by hand. The amount of effort was correlated to valve sticking problems in vehicles: i.e., valves that could not be pushed open by hand generally correlated with cold starting problems in vehicles.

CRC IV Test

The intake system components (valve, manifold, cylinder head) and combustion chamber were rated visually according to standard Coordinating Research Council (CRC) procedures (scale from 1-10: 1=dirty; 10=clean). The performance of the test fuel was measured in part by the cleanliness of the intake system components.

The Honda Generator intake valve keep clean test results are summarized in table Table 5:

TABLE 5

| | CRC IV | Wt., mg., IV | IV Stickiness |
|---|---|---|---|
| Example D | 8.6 | 300 | Fail |
| Example E | 9.4 | 30 | Pass |

These test results illustrate the intake valve "keep clean" detergent activity of the motor fuel composition of the present invention. The engine operated with the motor fuel additive composition of the present invention formed only 1/10 (i.e., a full order of magnitude) of the amount of carbonaceous deposit (by weight) as did the engine operated on a motor fuel which did not contain a sufficient amount of the heavy oil component of the motor fuel additive of the present invention. In addition, the motor fuel composition of the present invention passed the IV Stickiness test, while the comparison fuel failed.

Motor fuel and concentrate compositions of the instant invention may additionally comprise any of the additives generally employed in motor fuel compositions. Thus, compositions of the instant invention may additionally contain conventional anti-knock compounds, such as tetraethyl lead compounds, anti-icing additives, upper cylinder lubricating oils, and the like.

It will be evident that the terms and expressions employed herein are used as terms of description and not of limitation. There is no intention, in the use of these descriptive terms and expressions, of excluding equivalents of the features described and it is recognized that various modifications are possible within the scope of the invention claimed.

What is claimed is:

1. A motor fuel additive composition which comprises:

a first component comprising:

between about 65 wt % and about 95 wt. %, based upon the total weight of the first component, of a bis-succinimide of general formula:

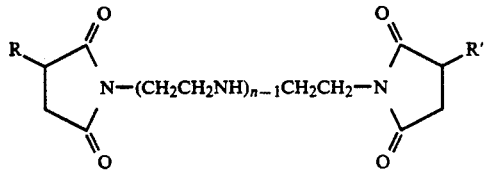

and between about 35 wt. % and about 5 wt. %, based upon the total weight of the first component, of a mono-succinimide of general formula:

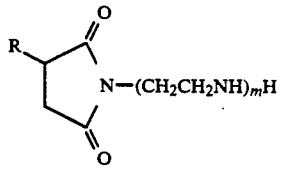

where R and R' are polyalkenyl radicals with average molecular weights of about 300 to about 4000 and n and m are integers between about 2 and about 6; and a second component comprising a heavy oil;

wherein the motor fuel additive composition comprises between about 25 wt. % and about 55 wt. % of the first component and between about 75 wt. % and about 45 wt. % of the second component, based upon the total weight of the motor fuel additive composition.

2. The motor fuel additive composition according to claim 1 wherein R and R' have average molecular weights of about 1000 to about 2500.

3. The motor fuel additive composition according to claim 1 wherein R and R' have average molecular weights of about 1200 to about 1500.

4. The motor fuel additive composition according to claim 1 wherein R and R' are polyisobutenyl radicals.

5. The motor fuel additive composition according to claim 1 wherein n and m are integers between about 2 and about 4.

6. The motor fuel additive composition according to claim 1 wherein n and m are the integer 3.

7. The motor fuel additive composition according to claim 1 wherein the first component comprises between about 75 wt. % and about 85 wt. % of the bis-succinimide and between about 25 wt. % and about 15 wt. % of the mono-succinimide, based upon the total weight of the first component.

8. The motor fuel additive composition according to claim 1 wherein the first component comprises between about 80 wt. % and about 85 wt. % of the bis-succinimide and between about 20 wt. % and about 15 wt. % of the mono-succinimide, based upon the total weight of the first component.

9. The motor fuel additive composition according to claim 1 which comprises between about 25 wt. % and about 45 wt. % of the first component and between about 75 wt. % and about 55 wt. % of the second component, based upon the total weight of the motor fuel additive composition.

10. The motor fuel additive composition according to claim 1 which comprises between about 30 wt. % and about 40 wt. % of the first component and between about 70 wt. % and about 60 wt. % of the second component, based upon the total weight of the motor fuel additive composition.

11. A motor fuel composition comprising:

a major portion of a hydrocarbon fuel boiling in the range between 90° F. and 450° F.; and a minor portion, sufficient to reduce the formation of deposits in fuel injectors and on intake valves, of an additive composition which comprises:

a first component comprising between about 65 wt. % and about 95 wt. %, based upon the total weight of the first component, of a bis-succinimide of general formula:

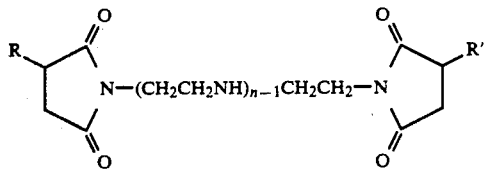

and between about 35 wt. % and about 5 wt. %, based upon the total weight of the first component, of a mono-succinimide of general formula:

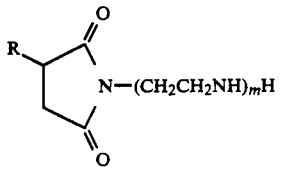

where R and R' are a polyalkenyl radicals with average molecular weights of about 300 to about 4000 and n and m are integers between about 2 and about 6; and a second component comprising a heavy oil;

wherein the motor fuel additive composition comprises between about 25 wt. % and about 55 wt. % of the first component and between about 75 wt. % and about 45 wt. % of the second component, based upon the total weight of the motor fuel additive composition.

12. The motor fuel composition according to claim 11 wherein R and R' have average molecular weights of about 1000 to about 2500.

13. The motor fuel composition according to claim 11 wherein R and R' have average molecular weights of about 1200 to about 1500.

14. The motor fuel composition according to claim 11 wherein R and R' are polyisobutenyl radicals.

15. The motor fuel composition according to claim 11 wherein n and m are integers between about 2 and about 4.

16. The motor fuel composition according to claim 11 wherein n and m are the integer 3.

17. The motor fuel composition according to claim 11 wherein the first component comprises between about 75 wt. % and about 85 wt. % of the bis-succinimide and between about 25 wt. % and about 15 wt. % of the mono-succinimide, based upon the total weight of the first component.

18. The motor fuel composition according to claim 11 wherein the first component comprises between about 80 wt. % and about 85 wt. % of the bis-succinimide and between about 20 wt. % and about 15 wt. % of the mono-succinimide, based upon the total weight of the first component.

19. The motor fuel composition according to claim 11 which comprises between about 25 wt. % and about 45 wt. % of the first component and between about 75 wt. % and about 55 wt. % of the second component, based upon the total weight of the motor fuel additive composition.

20. The motor fuel composition according to claim 11 which comprises between about 30 wt. % and about 40 wt. % of the first component and between about 70 wt. % and about 60 wt. % of the second component, based upon the total weight of the motor fuel additive composition.

21. The motor fuel composition according to claim 11 wherein the concentration of the additive composition is about 90 to about 360 PTB.

22. The motor fuel composition according to claim 11 wherein the concentration of the additive composition is about 135 to about 270 PTB.

23. The motor fuel composition according to claim 11 wherein the concentration of the additive composition is about 150 to about 200 PTB.

24. A motor fuel additive concentrate comprising a diluent and between 1 and 50 wt. %, based upon the total weight of the motor fuel additive concentrate, of an additive composition which comprises:

a first component comprising between about 65 wt. % and about 95 wt. %, based upon the total weight of the first component, of a bis-succinimide of general formula:

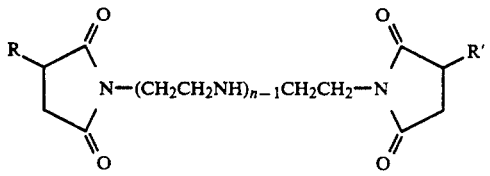

and between about 35 wt. % and about 5 wt. %, based upon the total weight of the first component, of a mono-succinimide of general formula:

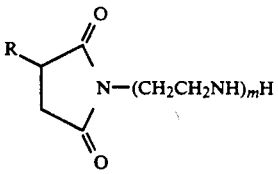

where R and R' are a polyalkenyl radicals with average molecular weights of about 300 to about 4000 and n and m are integers between about 2 and about 6; and a second component comprising a heavy oil;

wherein the motor fuel additive composition comprises between about 25 wt. % and about 55 wt. % of the first component and between about 75 wt. % and about 45 wt. % of the second component, based upon the total weight of the motor fuel additive composition.

* * * * *